US008968483B2

(12) United States Patent
Slabbekoorn et al.

(10) Patent No.: US 8,968,483 B2
(45) Date of Patent: Mar. 3, 2015

(54) METHOD OF USING LIQUID IN A DISHWASHER

(75) Inventors: Scott D. Slabbekoorn, Saint Joseph, MI (US); Elliott V. Stowe, Stevensville, MI (US); Barry E. Tuller, Stevensville, MI (US); Chad T. Vanderroest, Covert, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 247 days.

(21) Appl. No.: 13/608,049

(22) Filed: Sep. 10, 2012

(65) Prior Publication Data

US 2014/0069465 A1 Mar. 13, 2014

(51) Int. Cl.
*A47L 15/14* (2006.01)

(52) U.S. Cl.
USPC ..... 134/25.2; 134/10; 134/57 D; 134/56 D

(58) Field of Classification Search
CPC ..... A47L 15/0007; A47L 15/001; A47L 15/4219; A47L 15/4291
USPC ..... 134/25.2, 10, 57 D, 56 D
See application file for complete search history.

(56) References Cited

U.S. PATENT DOCUMENTS

| | | | | |
|---|---|---|---|---|
| 2,721,574 | A | 10/1955 | Parker | |
| 4,156,621 | A | 5/1979 | Andrews et al. | |
| 4,641,671 | A | 2/1987 | Nogi et al. | |
| 4,776,891 | A | 10/1988 | Murtha | |
| 5,017,852 | A | 5/1991 | Nagata et al. | |
| 5,106,493 | A | 4/1992 | McIntosh | |
| 5,173,180 | A | 12/1992 | Stewart et al. | |
| 5,307,650 | A | 5/1994 | Mertz | |
| 5,488,965 | A | 2/1996 | Hori | |
| 5,617,885 | A | 4/1997 | Centis | |
| 5,729,025 | A | 3/1998 | Erickson et al. | |
| 5,829,459 | A | 11/1998 | Milocco et al. | |
| 5,868,937 | A | 2/1999 | Back et al. | |
| 5,899,097 | A | 5/1999 | Adler | |
| 6,393,643 | B1 | 5/2002 | Wientjens | |
| 6,591,846 | B1 | 7/2003 | Ferguson et al. | |
| 7,000,437 | B2 | 2/2006 | Raney et al. | |
| 7,186,345 | B2 | 3/2007 | Lee et al. | |
| 7,469,704 | B2 | 12/2008 | Fransson | |
| 7,597,108 | B2 | 10/2009 | Giefer et al. | |
| 7,691,209 | B2 | 4/2010 | Reichold | |
| 8,038,802 | B1 * | 10/2011 | Tuller | 134/25.2 |
| 2007/0022789 | A1 | 2/2007 | Heiligenmann et al. | |
| 2007/0267048 | A1 | 11/2007 | Eiermann et al. | |
| 2007/0277854 | A1 | 12/2007 | Eiermann et al. | |
| 2008/0148784 | A1 | 6/2008 | Ikematsu et al. | |
| 2010/0000577 | A1 | 1/2010 | Heiligenmann et al. | |
| 2011/0114140 | A1 | 5/2011 | Heisele et al. | |

(Continued)

FOREIGN PATENT DOCUMENTS

| | | | |
|---|---|---|---|
| CN | 101254085 | A | 9/2008 |
| CN | 101642361 | A | 2/2010 |

(Continued)

*Primary Examiner* — Michael Kornakov
*Assistant Examiner* — Katelyn Whatley

(57) ABSTRACT

A method of operating a dishwasher having a treating chamber for washing dishes includes dispensing a detergent, supplying liquid to mix with the detergent to form a wash liquid, storing a first portion of the wash liquid in a reuse tank and using a second portion of the wash liquid in the treating chamber, supplying the first portion of the wash liquid from the reuse tank to the treating chamber.

12 Claims, 4 Drawing Sheets

(56) References Cited

U.S. PATENT DOCUMENTS

| | | | |
|---|---|---|---|
| 2011/0253173 | A1 | 10/2011 | Fransson |
| 2012/0048314 | A1 | 3/2012 | Vitan et al. |
| 2012/0118339 | A1 | 5/2012 | Ertl et al. |

FOREIGN PATENT DOCUMENTS

| | | | |
|---|---|---|---|
| DE | 3913355 | A1 | 10/1990 |
| DE | 4004057 | A1 | 8/1991 |
| DE | 4243605 | C2 | 1/1998 |
| DE | 102007041308 | A1 | 3/2009 |
| EP | 0467028 | B1 | 1/1992 |
| EP | 0578006 | A1 | 1/1994 |
| EP | 0560025 | B1 | 12/1996 |
| EP | 0771898 | B1 | 5/1997 |
| EP | 0607628 | B1 | 12/1997 |
| EP | 0911438 | B1 | 4/1999 |
| EP | 0911439 | B1 | 4/1999 |
| EP | 0914800 | B1 | 5/1999 |
| EP | 0914799 | B1 | 4/2003 |
| EP | 0691099 | B1 | 12/2003 |
| EP | 1219228 | B1 | 4/2007 |
| EP | 0914800 | B1 | 6/2008 |
| EP | 2058523 | A2 | 5/2009 |
| EP | 2127587 | A1 | 12/2009 |
| EP | 2031120 | B1 | 1/2010 |
| FR | 2285838 | A | 4/1976 |
| JP | 2142524 | A | 5/1990 |
| JP | 4129597 | A | 4/1992 |
| JP | 7265252 | A | 10/1995 |
| JP | 11104393 | A | 4/1999 |
| JP | 2000350693 | A | 12/2000 |
| JP | 2002263050 | A | 9/2002 |
| JP | 2006167347 | A | 6/2006 |
| JP | 2006239275 | A | 9/2006 |
| JP | 2007007178 | A | 1/2007 |
| JP | 2009090125 | A | 4/2009 |
| JP | 2010057754 | A | 3/2010 |
| KR | 20050046628 | A | 5/2005 |
| KR | 20060012437 | A | 2/2006 |
| KR | 20080075693 | A | 8/2008 |
| KR | 20090038504 | A | 4/2009 |
| KR | 20100031175 | A | 3/2010 |
| WO | 2005/051157 | A1 | 6/2005 |
| WO | 2006/063895 | A1 | 6/2006 |
| WO | 2006/073373 | A1 | 7/2006 |
| WO | 2009/004019 | A1 | 1/2009 |
| WO | 2009/027320 | A1 | 3/2009 |
| WO | 2010009890 | A1 | 1/2010 |
| WO | 2011026756 | A2 | 3/2011 |

* cited by examiner

METHOD OF USING LIQUID IN A DISHWASHER

BACKGROUND OF THE INVENTION

Contemporary dishwashers for use in a typical household include a tub for storing dishes during the implementation of a wash cycle within the tub for cleaning of the stored dishes. A reuse tank may be provided to store liquid captured from the tub during a previous wash/rinse phase of the wash cycle. The stored liquid may be used in the same or subsequent wash cycles.

BRIEF DESCRIPTION OF THE INVENTION

The invention relates to a method of operating a dishwasher having a treating chamber for receiving dishes according to an automatic cycle of operation, the method includes dispensing a detergent into the treating chamber, supplying of liquid to the treating chamber to mix with the detergent to form a wash liquid, storing a first portion of the wash liquid in a reuse tank in the dishwasher and using a second portion of the wash liquid in the treating chamber, supplying the first portion of the wash liquid from the reuse tank to the treating chamber, recirculating the first portion of the wash liquid through the treating chamber, and removing the wash liquid from the treating chamber.

DESCRIPTION OF EMBODIMENTS OF THE INVENTION

Figure 1:
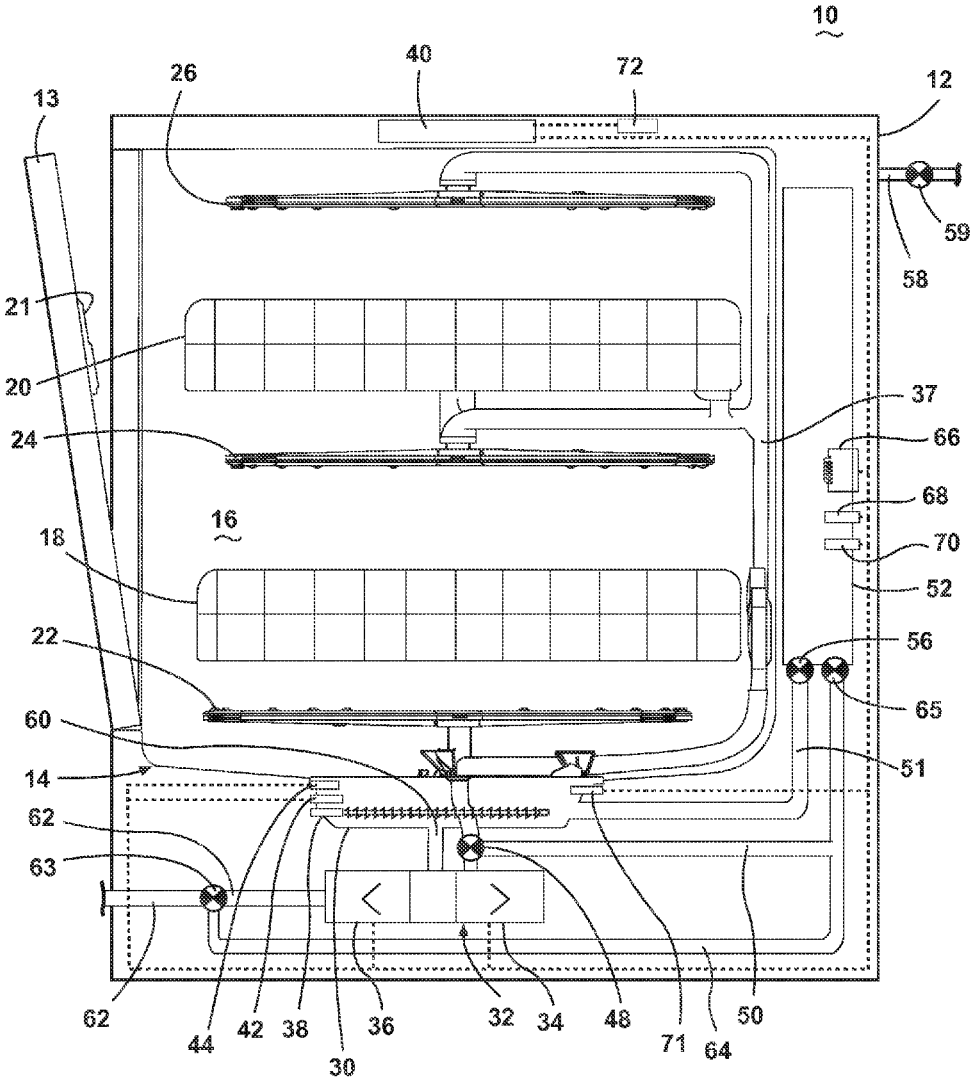
FIG. 1 is a schematic, side view of a dishwasher according to a first embodiment of the invention.

FIG. 1 is a schematic, side view of a treating appliance according to a first embodiment of the invention, which is illustrated in the context of a dishwasher 10. While the illustrated treating appliance is a dishwasher 10, other treating appliances are possible, non-limiting examples of which include other types of dishwashing units, such as in-sink dishwashers, multi-tub dishwashers, or drawer-type dishwashers. The dishwasher 10, which shares many features of a conventional automated dishwasher, will not be described in detail herein except as necessary for a complete understanding of the invention.

The dishwasher 10 may have a cabinet 12 defining an interior, which is accessible through a door 13. The cabinet 12 may include a chassis or frame to which panels may be mounted. For built-in dishwashers, the outer panels are typically not needed. At least one tub 14 is provided within the interior of the cabinet 12 and defines a treating chamber 16 to receive and treat dishes according to a cycle of operation, often referred to a wash cycle whether or not washing occurs. The tub 14 has an open face that is closed by the door 13.

For purposes of this description, the term "dish(es)" is intended to be generic to any item, single or plural, that may be treated in the dishwasher 10, including, without limitation; utensils, plates, pots, bowls, pans, glassware, and silverware.

One or more dish racks, such as a lower dish rack 18 and an upper dish rack 20 may be provided in the treating chamber 16. The racks 18, 20 hold dishes (not shown) that may be treated in the treating chamber 16. The racks 18, 20 may be slid in and out of the treating chamber 16 through the opening closed by the door 13.

A detergent dispenser 21 may be located in the door 13. It will be understood that depending on the type of dishwasher and the type of detergent used, the detergent dispenser 21 may be incorporated into one dispensing mechanism. The detergent dispenser 21 may be of a single use dispenser type or a bulk dispenser type. In the case of bulk dispensing, the detergent and/or rinse aid can be selectively dispensed into the treating chamber 16 in a regulated quantity and at a predetermined time or multiple times during a cycle of operation. The detergent dispenser 21 may have a door or other mechanism through which the detergent may be dispensed. Further, in the case of a bulk dispenser the detergent dispenser 21 may include a pump or other mechanism for supplying a quantity of detergent to the treating chamber 16.

A liquid supply system is provided for supplying liquid to the treating chamber 16 as part of a wash cycle for washing any dishes within the racks 18, 20. The liquid supply system includes one or more liquid sprayers, which are illustrated in the form of spray arm assemblies 22, 24, 26, that are provided within the treating chamber 16 and are oriented relative to the racks 18, 20 such that liquid sprayed from the spray arm assemblies 22, 24, 26 may be directed into one or more of the racks 18, 20.

It should be noted that the stacked arrangement of the dish racks and the spray arm assemblies is not limiting to the invention. It merely serves to illustrate the invention. For example, the invention may be implemented in a stacked arrangement having a silverware basket, the lower and upper dish rack, and with upper, middle, and lower level spray arm assemblies having spray heads for the silverware basket alternatively arranged in between the lower and upper dish rack.

The liquid supply system may include a sump 30 to collect by gravity, liquid sprayed within the treating chamber 16. The sump 30 is illustrated as being formed with or affixed to a lower portion of the tub 14 to collect liquid that may be supplied into or circulated in the tub 14 during, before, or after a cycle of operation. However, the sump 30 may be remote from the tub 14 and fluidly coupled by suitable fluid conduits.

A pump assembly 32 fluidly coupled to the sump 30 may also be included in the liquid supply system and may include a wash pump or recirculation pump 34 and a drain pump 36. The recirculation pump 34 fluidly couples the sump 30 to the spray arm assemblies 22, 24, 26 through a spray arm supply conduit 37 to recirculate liquid that collects in the sump to the spray arm assemblies 22, 24, 26 for spraying on the racks 18, 20. The drain pump 36 fluidly couples the sump 30 to a drain conduit 62 for draining liquid collected in the sump 30 to a household drain, such as a sewer line, or the like.

A reuse tank 52 for storing liquid captured during one or more phases/steps of a wash cycle for later use in the current wash cycle and/or a subsequent wash cycle may also be included in the liquid supply system. The reuse tank 52 may be fluidly coupled to the recirculation pump 34 by a reuse tank supply conduit 50 so that liquid from the sump 30 may be supplied to the reuse tank 52. A control valve 48 controls the liquid from the recirculation pump 34 to either the spray arm supply conduit 37 or the reuse tank supply conduit 50. The reuse tank 52 may also be fluidly coupled to the sump 30 by an outlet conduit 51 such that liquid in the reuse tank 52 may be supplied to the sump 30 for subsequent use. A control valve 56 is provided in the outlet conduit 51 to control the supply of liquid from the reuse tank 52 to the sump 30. A supply conduit 64 may fluidly couple the reuse tank 52 to the drain pump 36 through a drain conduit 62 and a control valve 63. The control valve 63 is provided to control the flow of liquid from the drain pump 36 to either the drain conduit 62 or the reuse tank 52.

As illustrated, the physical relationship between the reuse tank 52 and the sump 30 uses gravity to supply the liquid from the reuse tank 52 to the sump 30. Thus, liquid from the sump 30 may be supplied to the reuse tank 52 by either combination of recirculation pump 34, control valve 56, outlet conduit 51 or drain pump 36, control valve 63, supply conduit 64, and valve 65. With either configuration, the actuation of the corresponding control valve 48, 63 will redirect the output of the recirculation pump 34 or drain pump 36, respectively, to the reuse tank 52, through the corresponding conduit 50, 64 and the valve 65. However, it is contemplated that the reuse tank 52 may be provided at other locations, some of which may be incapable of using gravity to supply the reuse liquid to the sump. Thus, it is contemplated that a pump could be provided to pump liquid from the reuse tank 52 to the sump 30, regardless of whether gravity can be used to supply the reuse liquid.

While liquid may be provided to the reuse tank 52 through the tub 14 and the sump 30, the liquid may be directly provided to the reuse tank 52. For example, liquid having at least one of water, detergent, and treatment aid may be separately provided in the reuse tank 52 to form the liquid. Alternatively, premixed mixture having at least one of water, detergent, and treatment aid may be directly provided in the reuse tank 52 to clean the reuse tank 52.

It is noted that the supplying of liquid from the sump 30 to the reuse tank 52 may be reiterated multiple times for the multiple wash/rinse phases of a cycle of operation until multiple capture steps may provide enough amount of liquid which is sufficient to fill up the reuse tank 52 while only one time capturing step during any wash/rinse phase may be performed. It is also noted that whole amount of liquid for any wash/rinse phase during a cycle of operation may be captured to the reuse tank 52 through either the recirculation pump 34 or drain pump 36 while only a portion of the liquid in the tub 14 may be captured and provided to the reuse tank 52.

Further as illustrated, the liquid in the reuse tank 52 may be drained by supplying the liquid to the sump 30 and then actuating the drain pump 36. It is contemplated that a separate drain conduit (not shown) can be provided from the reuse tank 52 to the drain pump 36 to directly drain the liquid in the reuse tank without the liquid entering the sump.

While the pump assembly 32 may include the recirculation pump 34 and the drain pump 36, in an alternative embodiment, the pump assembly 32 may include a single pump, which may be operated to supply liquid to either the drain conduit 62 or the spray arm support conduit 37, such as by rotating in opposite directions or by valves.

A water supply conduit 58 may fluidly couple a water supply to the treating chamber 16. A control valve 59 may control the flow of water from the household supply to the treating chamber 16. The water may be supplied to any portion of the treating chamber 16. It is also contemplated that the water supply conduit 58 may supply water directly to the sump 30 or to a portion of the detergent dispenser 21.

A control system having various components and sensors for controlling the flow and condition of the liquid to implement a wash cycle may be included in the dishwasher 10. The control system includes a heater 38 that may be located within the sump 30 to selectively heat liquid collected in the sump 30. The heater 38 may be an immersion heater in direct contact with liquid in the sump 30 to provide the liquid with predetermined heat energy. A temperature sensor such as a thermistor 42 may be provided in the sump 30 to provide an output that is indicative of the temperature of any fluid, liquid or air, in the sump 30. A pH sensor 44 may also be located near the bottom of the wall or in the sump 30 and provide an output indicative of the pH of the liquid in the sump 30. A turbidity sensor 71 may also be located in the sump 30, near the bottom of the wall, or near the pump assembly 32 and provide an output that is indicative of the turbidity of the liquid in the sump 30.

A heater 66 may be provided in the reuse tank 52 to heat the liquid in the reuse tank 52. A thermistor 68 may be provided in the reuse tank and output a signal indicative of the temperature within the reuse tank 52. Similar to the heater 38, the heater 66 may also be in a direct fluid contact with liquid in the reuse tank 52 to provide heat energy to the liquid stored in the reuse tank 52. The thermistor 68 may be positioned such that the thermistor 68 may be in direct fluid contact with liquid in the reuse tank 52 during measurement. A pH sensor 70 may be coupled to the reuse tank 52 to output a signal indicative of the pH of liquid in the reuse tank 52. Additional sensors may be operably coupled to the reuse tank to monitor the characteristics of liquid in the reuse tank 52.

It is also noted that additional sensors may be fluidly coupled to the tub 14 or reuse tank 52 to provide output indicative of condition of the liquid. Non-limiting examples of additional sensors include a turbidity sensor and a conductivity sensor.

Figure 2:
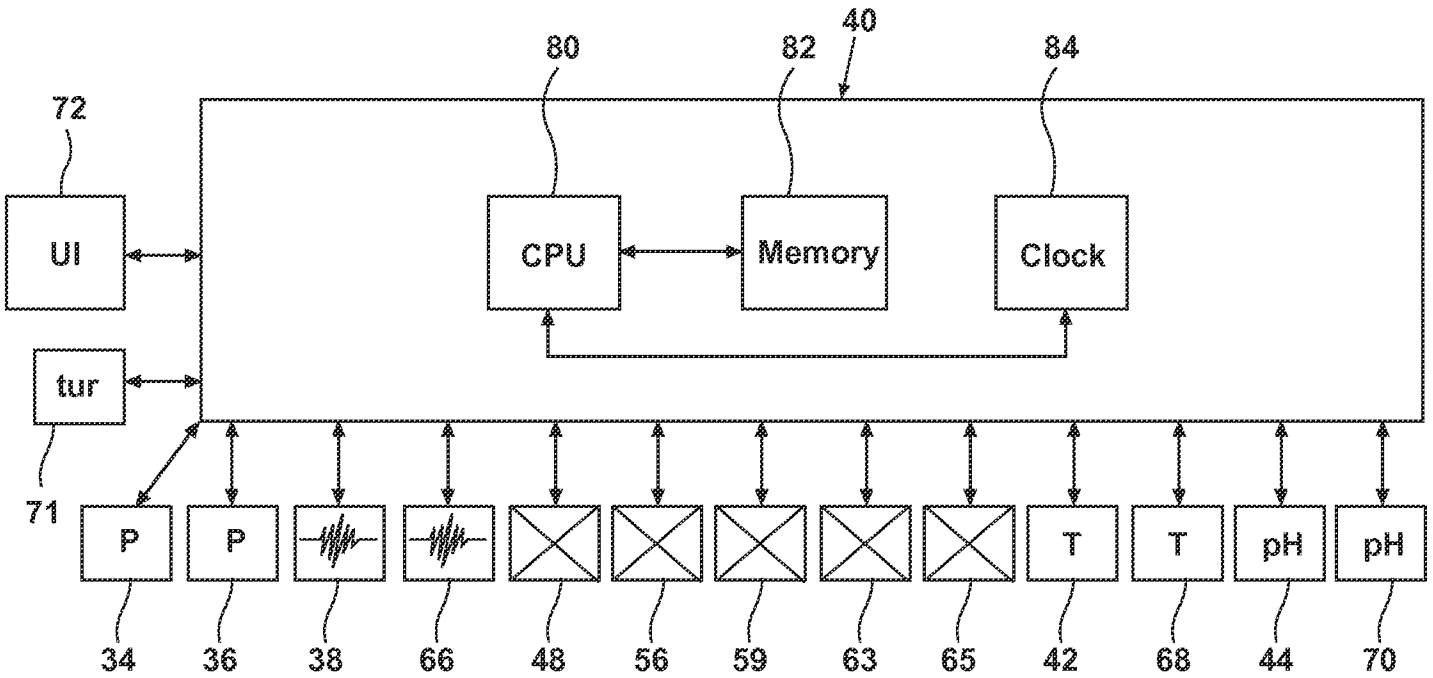
FIG. 2 is a schematic view of a control system of the dishwasher in FIG. 1.

A controller 40 may be included in the dishwasher 10 for implementing one or more cycles of operation. As seen in FIG. 2, the controller 40 is operably coupled to the pumps 34, 36, heaters 38, 66, control valves 48, 56, 59, 63, 65, thermistors 42, 68, pH sensors 44, 70, and a turbidity sensor 71 to either control these components and/or receive their input for use in controlling the components. The controller 40 is also operably coupled to a user interface 72 to receive input from a user for the implementation of the wash cycle and provide the user with information regarding the wash cycle. In this way, the controller 40 can implement a wash cycle selected by a user according to any options selected by the user and provide related information to the user.

The controller 40 may also include a central processing unit (CPU) 80 and an associated memory 82 where various wash cycle and associated data, such as look-up tables, algorithms, may be stored. Non-limiting examples of treatment cycles include normal, light/china, heavy/pots and pans, and rinse only. One or more software applications, such as an arrangement of executable commands/instructions may be stored in the memory and executed by the CPU 80 to implement the one or more wash cycles. The controller 40 may further include a clock 84. The clock 84 may be alternatively located in another component operably coupled to the controller 40.

The user interface 72 provided on the dishwasher 10 and coupled to the controller 40 may include operational controls such as dials, lights, knobs, levers, buttons, switches, and displays enabling the user to input commands to the controller 40 and receive information about the selected treatment cycle. The user interface 72 may be used to select a treatment cycle to treat a load of dishes. Alternatively, the treatment cycle may be automatically selected by the controller 40 based on the soil levels sensed by any sensors in the dishwasher 10 to optimize the treatment performance of the dishwasher 10 for a particular load of dishes.

During operation of the dishwasher 10, the controller 40 may be employed to control the components including the liquid supply system, the detergent dispenser 21, and the pump assembly 32 to operate the dishwasher 10 according to a cycle of operation. In operation, liquid, such as water and/or treating chemistry (i.e., water and/or detergents, enzymes, surfactants, and other cleaning or conditioning chemistry), may enter the tub 14 and flows into the sump 30. Liquid may then be directed back to the treating chamber through the spray assemblies 22-26, to the ruse tank 52, or to the drain conduit 62. The drain pump 36 and/or the recirculation pump 34 may be used to store liquid in the reuse tank 52. Any liquid and soils in the tub 14 may be drained by the drain pump 36.

Figure 3:
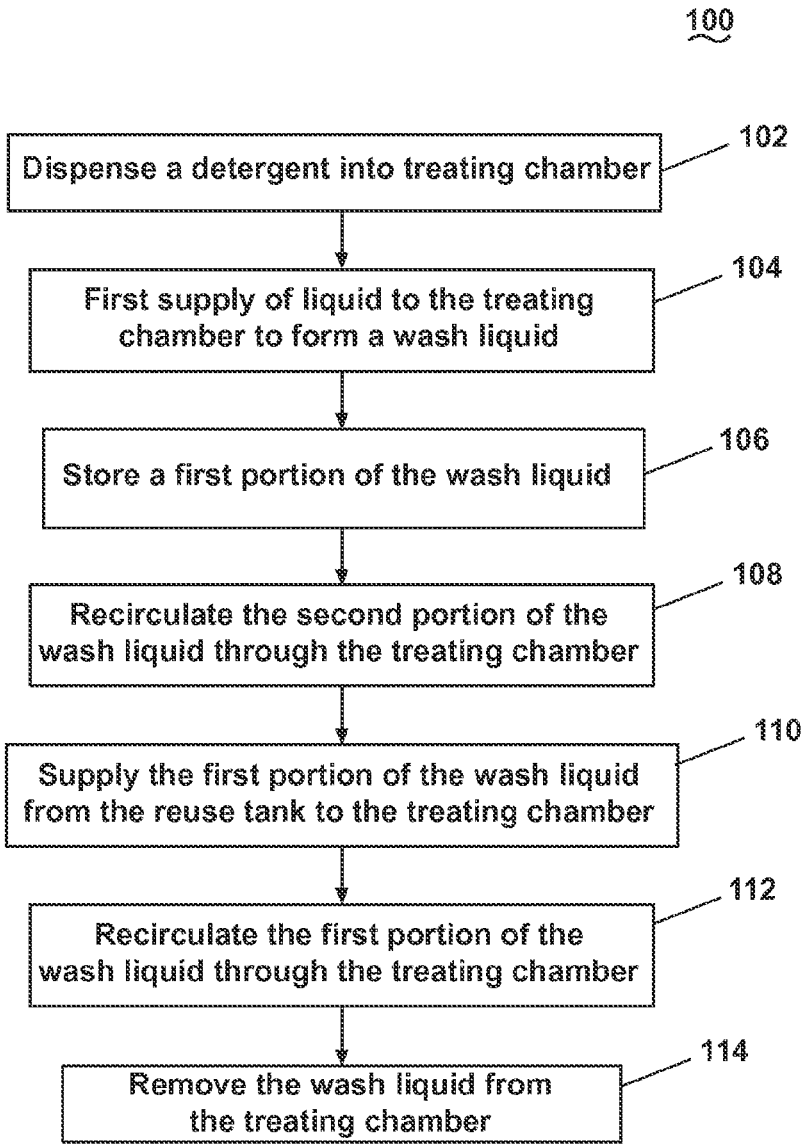
FIG. 3 is a flow chart of the operation of the dishwasher according to a second embodiment of the invention.
Figure 4:
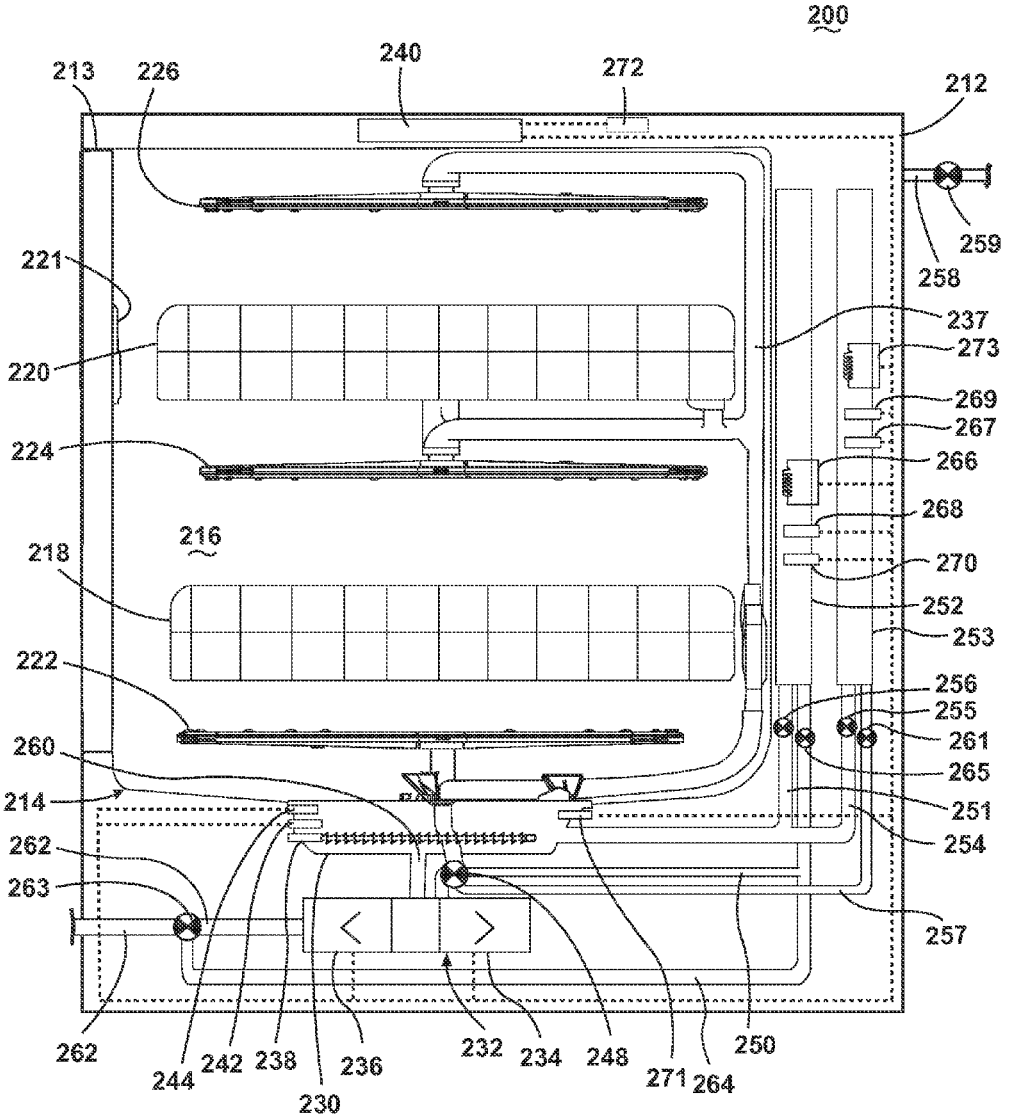
FIG. 4 is a schematic, side view of a dishwasher according to a third embodiment of the invention.

The dishwasher 10 may be operated in a variety of manners to obtain a variety of benefits. Including that, in one embodiment, the dishwasher 10 may be operated to store a first portion of the wash liquid in a reuse tank in the dishwasher and using a second portion of the wash liquid in the treating chamber. For example, FIG. 3 is a flow chart of the operation of the dishwasher 10 according to a second embodiment of the invention. The sequence of steps depicted in FIG. 4 is for illustrative purposes only, and is not meant to limit the method in any way as it is understood that the steps may proceed in a different logical order, additional or intervening steps may be included, or described steps may be divided into multiple steps, without detracting from the invention. The method may be implemented multiple times, either consecutively or intermittently, during, after or before a wash cycle. The method may be incorporated into a cycle of operation for the dishwasher 10, such as prior to or as part of any phase of the wash cycle or the method may also be a stand-alone cycle. It is noted that the method may be used with or without the dishes placed within the treating chamber 16.

The method 100 may begin at 102 by dispensing a detergent into the treating chamber 16. More specifically, detergent may be dispensed from the detergent dispenser 21. In the case where the detergent dispenser 21 may be of a single use dispenser type, the controller 40 may open a door of the detergent dispenser 21 to dispense the detergent into the treating chamber 16. In the case where the detergent dispenser 21 is a bulk dispenser type dispenser the controller 40 may actuate a portion of the detergent dispenser 21, such as a pump of the detergent dispenser to dispense the detergent into the treating chamber 16.

At 104 a first amount of liquid, such as water, may be supplied to the treating chamber 16 to mix with the detergent to form a wash liquid. The control valve 59 may be operated to provide a flow of water from the household supply to the treating chamber 16. When the liquid is supplied to the treating chamber 16, the liquid may be collected in the sump 30 due to gravity. It is also contemplated that the liquid may be supplied directly to the sump 30. Alternatively, it is contemplated that this may be done simultaneously with the addition of the detergent. For example, the water and the detergent may be pre-mixed before the mixture of water and the detergent is provided to the treating chamber 16. It is also contemplated that liquid may be supplied from the reuse tank 52 to the treating chamber 16 to mix with the detergent to form a wash liquid at 104.

At 106, a first portion of the wash liquid may be stored in the reuse tank 52 while a second portion of the wash liquid may remain in the treating chamber for use of the second portion of the wash liquid. The first portion may be stored in the reuse tank through operation of the pump assembly 32. It is contemplated that either the drain pump 36 or the recirculation pump 34 may be used to store the first portion of the wash liquid in the reuse tank 52. More specifically, the first portion of the wash liquid may be drained through the drain pump 36. The output of the drain pump 36 may be directed to the supply conduit 64 feeding the reuse tank 52 by the actuation of the control valve 63 until the first portion is stored. Alternatively, the control valve 48 may be actuated to direct the flow of liquid from the recirculation pump 34 to the reuse tank 52 to store the first portion of the wash liquid. More specifically, the output of the recirculation pump 34 may be directed to the conduit 50 feeding the reuse tank 52 by the actuation of the control valve 48 until the first portion is stored. The second portion of the wash liquid may then be used within the treating chamber 16.

Regardless of which pump is used to store the first portion of the wash liquid in the reuse tank 52, the controller 40 may control the pump to store the first portion of the wash liquid in the reuse tank 52. It is contemplated that the first portion of wash liquid may be a predetermined amount and that a sensor such as a flow meter may be used to accurately store such an amount. Alternatively, a time-based approach may be used where the controller 40 operates the pump for a time period, which is sufficient to store the first portion of wash liquid. Such a time period may be empirically determined based on anticipated liquid volumes. The time-based approach runs the risk of under/over-shooting each of the portions if the volume condition varies from what was anticipated or for some reason the pump does not pump at the anticipated rate.

At 108, after the storing of the first portion, the second portion of the wash liquid may be recirculated in the treating chamber 16. More specifically, the second portion of the wash liquid may be recirculated to at least one of the spray arm assemblies 22, 24, 26 to provide a spray of liquid to clean the dishes in the dish racks 18, 20 in the treating chamber 16 according to a wash cycle. This may be done by directing the output of the recirculation pump 34 to the spray assemblies 22-26 through use of the control valve 48. The recirculated second portion of the wash liquid may remove soil particles from any dishes within the treating chamber 16 and may form a wash liquid comprising a mixture of the second portion of the wash liquid and the soil particles. Alternatively, the second portion of the wash liquid may recirculate in the treating chamber 16 without the presence of dishes inside the treating chamber 16, to remove any micro-organisms in the spray arm assemblies 22, 24, 26, spray arm supply conduit 37, and/or the treating chamber 16, or to clean any remaining food soil in the treating chamber 16 that may have left from the previous wash cycle.

At 110, the first portion of the wash liquid may be supplied from the reuse tank 52 to the treating chamber 16. The stored liquid may be supplied back to the treating chamber 16 by gravity using outlet conduit 51 and control valve 56. At 112, the first portion of the wash liquid may be recirculated through the treating chamber similarly to the recirculation of the liquid at 408. At 414, when the recirculation ceases, the wash liquid having food soils, stains, or other impurities may be removed from the treating chamber 16. More specifically, the wash liquid may be drained from the sump 30 by the drain pump 36, with the control valve 63 actuated to direct the output of the drain pump 36 down the drain conduit 62. It is further contemplated that after the recirculating of the first portion at least some of the wash liquid may be stored in the reuse tank 52.

Regardless of the type of detergent dispenser 21 and the timing, it is contemplated that an amount of detergent for a single dose wash phase may be dispensed. Further, the first supply of liquid at 404 may include supplying an amount of liquid greater than a volume for a single dose wash phase, resulting in the wash liquid having a concentration of detergent less a single wash phase. In such an instance, the volume of the second portion may be a volume for a single dose wash phase. The volume of the first portion may also be a volume for a single dose wash phase.

It will be understood that the method 100 illustrated is merely for illustrative purposes. For example, the sequence of steps depicted is for illustrative purposes only, and is not meant to limit the method 100 in any way as it is understood that the steps may proceed in a different logical order or additional or intervening steps may be included without detracting from the embodiment of the invention. For example, at least some of the second portion of the wash liquid may be removed from the treating chamber 16 prior to the supplying of the first portion. Further, all of the second portion of the wash liquid may be removed from the treating chamber 16 prior to the supplying of the first portion. Alternatively, the first portion can be added to the second portion and the combined first and second portions can be recirculated.

A second amount of liquid may also be supplied to the treating chamber 16, such as water from the household supply, until the combined volume of the supplied first portion and the second amount is sufficient for a single wash phase. A third amount of liquid may also be supplied to the treating chamber 16, such as water from the household supply. Such a third supplying of water may form a rinse liquid in the treating chamber 16. The rinse liquid may then be recirculated to rinse the dishes. The rinse liquid may then be drained or a portion of the rinse liquid may be stored in the reuse tank 52.

FIG. 4 illustrates a dishwasher 200 according to a third embodiment. The third embodiment is similar to the first embodiment; therefore, like parts will be identified with like numerals increased by 200, with it being understood that the description of the like parts of the first embodiment applies to the fifth embodiment, unless otherwise noted.

One difference between the dishwasher 10 and the dishwasher 200 is that another or second reuse tank 253 is included in the dishwasher 200. The second reuse tank 253 may also be used for storing liquid captured during one or more phases/steps of a wash cycle for later use in the current wash cycle and/or a subsequent wash cycle. The second reuse tank 253, much like the first reuse tank 252, may be fluidly coupled to the recirculation pump 234 by a reuse tank supply conduit 250 so that liquid from the sump 230 may be supplied to the reuse tank 252. The control valve 248 may control the liquid from the recirculation pump 234 to the spray arm supply conduit 237, the reuse tank supply conduit 250 that leads to the first reuse tank 252, or the reuse supply tank conduit 257 leading to the second reuse tank 253. The reuse tank 253 may also be fluidly coupled to the sump 230 by an outlet conduit 254 such that liquid in the reuse tank 253 may be supplied to the sump 230 for subsequent use. A control valve 255 is provided in the outlet conduit 254 to control the supply of liquid from the reuse tank 253 to the sump 230. Although not illustrated a supply conduit may fluidly couple the reuse tank 253 to the drain pump 236 and a control valve may be provided to control the flow of liquid from the drain pump 236 to the drain conduit 262, the first reuse tank 252 or the second reuse tank 253. A heater 273, a thermistor 269, and a pH sensor 267 may be operably coupled to or included in the reuse tank 253 and operably coupled to the controller 240. Additional sensors may be operably coupled to the reuse tank 253 to allow the controller 240 to monitor the characteristics of liquid in the reuse tank 253.

It is contemplated that the dishwasher 200 may be operated much like the dishwasher 10. For example, the dishwasher 200 may also be operated to carry out the method 100. Either the first reuse tank 252 or the second reuse tank 253 may be used to store the first portion of the wash liquid while the second portion of the wash liquid is being used in the treating chamber 216. Further, it is contemplated that there may also be a second supplying of liquid to the treating chamber 216, such as water from the household supply, until the combined volume of the supplied first portion and the second supplying is sufficient for a single wash phase. There may also be a third supplying liquid to the treating chamber 216, such as water from the household supply. Such a third supplying of water may form a rinse liquid in the treating chamber 216. The rinse liquid may then be recirculated to rinse the dishes. The rinse liquid may then be drained or a portion of the rinse liquid may be stored in the first reuse tank 252 or the second reuse tank 253. Alternatively, a portion of the rinse liquid may be stored in the second reuse tank 253 before recirculation of the rinse liquid. It is contemplated that at least one of the first and second supplying liquid comprises supplying liquid from the another reuse tank 253. It is also contemplated that removing the wash liquid from the treating chamber 216 comprises storing at least some of the wash liquid in the first reuse tank or the another reuse tank 253.

The embodiments of the invention described herein provide methods for operating a dishwasher fluidly coupled to at least one reuse tank. The methods of the invention can advantageously be used when the user may need to save water or any other liquid resources provided to the dishwasher. Further, by selectively storing wash liquid that includes detergent in the reuse tank, the reuse tank may be cleaned by the wash liquid. That is, the wash liquid with the detergent therein may be allowed to sit in the reuse tank while the other portion is being used, which may aid in keep the reuse tank clean. Further, the wash liquid may then be used in the treating chamber in as a second wash of relatively clean wash liquid. Further, if cold liquid is supplied to the treating chamber and then stored in the reuse tank it may be heated, either by ambient air or by a heater in the reuse tank before being supplied to the treating chamber.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of operating a dishwasher having a treating chamber for receiving dishes according to an automatic cycle of operation, the method comprising:

dispensing a detergent into the treating chamber, wherein the dispensing the detergent comprises dispensing an amount of detergent for a single dose wash phase;

supplying a first amount of liquid to the treating chamber to mix with the detergent to form a wash liquid;

storing a first portion of the first wash liquid in a reuse tank in the dishwasher and using a second portion of the first wash liquid in the treating chamber;

recirculating the second portion of the first wash liquid through the treating chamber, with a recirculation pump, to remove soil particles from any dishes within the treating chamber and to form a soiled wash liquid comprising a mixture of the liquid and the soil particles;

supplying the first portion of the first wash liquid from the reuse tank to the treating chamber;

recirculating the first portion of the first wash liquid through the treating chamber; and removing the soiled wash liquid and the first portion of the first wash liquid from the treating chamber, wherein the supplying a first amount of liquid comprises supplying an amount of liquid greater than a volume for a single dose wash phase, resulting in the wash liquid having a concentration of detergent less than a single dose wash phase.

2. The method of claim 1 wherein the removing the second wash liquid and the first portion of the first wash liquid from the treating chamber comprises storing at least some of the second wash liquid and the first portion of the wash liquid in another reuse tank.

3. The method of claim 1 wherein the volume of the second portion of the wash liquid is a volume for a single dose wash phase.

4. The method of claim 3 wherein the volume of the first portion of the wash liquid is a volume for a single dose wash phase.

5. The method of claim 1 wherein the removing the soiled wash liquid and the first portion of the wash liquid from the treating chamber comprises removing at least some of the second portion of the wash liquid prior to the supplying of the first portion of the wash liquid.

6. The method of claim 5 wherein the removing at least some of the second portion of the wash liquid comprises removing all of the second portion of the wash liquid.

7. The method of claim 5, further comprising supplying a second amount of liquid to the treating chamber while the first portion of the wash liquid is present in the treating chamber until a combined volume of the first portion of the wash liquid and the second amount of liquid is sufficient for a single wash phase.

8. The method of claim 7 wherein the removing the soiled wash liquid and the first portion of the wash liquid comprises removing the soiled wash liquid from the treating chamber after the recirculation of the first portion of the wash liquid.

9. The method of claim 8, further comprising supplying a third amount of liquid to form a rinse liquid in the treating chamber and recirculating the rinse liquid to rinse the dishes.

10. The method of claim 9, further comprising storing at least a portion of the rinse liquid in a second reuse tank.

11. The method of claim 10 wherein at least one of the first and second amounts of liquid comprises liquid from the second reuse tank.

12. The method of claim 5, further comprising storing at least some of the first portion of the wash liquid in the reuse tank after the recirculating of the first portion of the wash liquid.

* * * * *